United States Patent [19]

Dice

[11] Patent Number: 5,037,243

[45] Date of Patent: Aug. 6, 1991

[54] ANCHOR FOR A RETAINING WALL DEAD MAN

[76] Inventor: Dennis L. Dice, 5803 Weir St., Omaha, Nebr. 68117

[21] Appl. No.: 606,104

[22] Filed: Oct. 31, 1990

[51] Int. Cl.[5] ..... E02D 29/02

[52] U.S. Cl. ..... 405/262; 405/284

[58] Field of Search ..... 405/258, 262, 272, 284, 405/285, 286; 52/155, 166

[56] References Cited

U.S. PATENT DOCUMENTS

| | | | |
|---|---|---|---|
| 720,025 | 2/1903 | Harbold | 52/166 X |
| 1,429,964 | 9/1922 | Nordstrom | 405/244 |
| 1,467,470 | 9/1923 | Borg | 405/262 |
| 2,638,231 | 5/1953 | Tardie et al. | 52/166 X |
| 4,834,585 | 5/1989 | Hasenwinkle et al. | 405/286 |

FOREIGN PATENT DOCUMENTS

| | | | |
|---|---|---|---|
| 41818 | 4/1959 | Poland | 405/284 |
| 607891 | 5/1978 | U.S.S.R. | 405/284 |

*Primary Examiner*—David H. Corbin

*Attorney, Agent, or Firm*—Zarley, McKee, Thomte, Voorhees & Sease

[57] ABSTRACT

An anchor for a dead man tie comprising a vertically disposed anchor portion which extends transversely from one side of the dead man tie adjacent the rearward end thereof and a second anchor portion which extends rearwardly and inwardly from the outer end of the first anchor portion. A third anchor portion extends forwardly from the inner end of the first anchor portion and is nailed to one side of the tie. A fourth anchor portion extends rearward from the rearward end of the second anchor portion and is nailed to one side of the tie. The anchor may be secured to one side of the tie or to both sides of the tie.

10 Claims, 3 Drawing Sheets

ANCHOR FOR A RETAINING WALL DEAD MAN

BACKGROUND OF THE INVENTION

This invention relates to an anchor for a retaining wall dead man, and more particularly to the anchor which is secured to the rearward end of the dead man tie employed in a retaining wall construction.

Many different types of retaining walls are used to retain soil therebehind. One type of retaining wall construction is to position a plurality of rows of wood ties, one upon the other, with the ties in each row being arranged in an end-to-end relationship. Normally, dead man ties are positioned in each row of ties and extend transversely from the row of ties into the soil being retained. The purpose of the dead man tie is to prevent the collapse of the retaining wall. However, it has been found that the dead man ties tend to pull from the soil being retained should the pressure within the soil become too great such as may be caused during periods of heavy rainfall.

It is therefore a principal object of the invention to provide an anchor for a retaining wall dead man.

A further object of the invention is to provide an anchor for a dead man tie which is secured to the rearward or inner end thereof to prevent the dead man tie from pulling from the soil being retained.

Yet another object of the invention is to provide an inexpensive anchor for a dead man tie.

Still another object of the invention is to provide an anchor for a dead man tie which may be used on one side of the dead man tie or on both sides of the dead man tie.

Yet another object of the invention is to provide an anchor for a dead man tie which is easily and quickly secured to the tie.

These and other objects of the present invention will be apparent to those skilled in the art.

SUMMARY OF THE INVENTION

An anchor for a dead man tie is disclosed adapted to be secured to at least one side of the man tie adjacent the rearward end thereof. The anchor comprises a first anchor portion which extends transversely outwardly from one side of the tie and a second anchor portion which extends rearwardly and inwardly from the outer end of the first anchor portion. A third anchor portion extends forwardly from the inner end of the first anchor portion and is secured to the tie by one or more nails extending therethrough into the tie. A fourth anchor portion extends rearwardly from the inner end of the second anchor portion and is secured to the tie by one or more nails extending therethrough into the tie. The anchor may be secured to one side of the tie or to opposite sides of the tie. When positioned in the soil being retained by the retaining wall construction, the first anchor portion aids in preventing the dead man tie from being pulled from the soil. The dead man tie is also prevented from being pulled from the soil by the fact that soil is positioned between the first and second anchor portions. The anchor may be either secured to square or rectangular ties or to wooden members having arcuate sides.

DESCRIPTION OF THE PREFERRED EMBODIMENT

Figure 1:
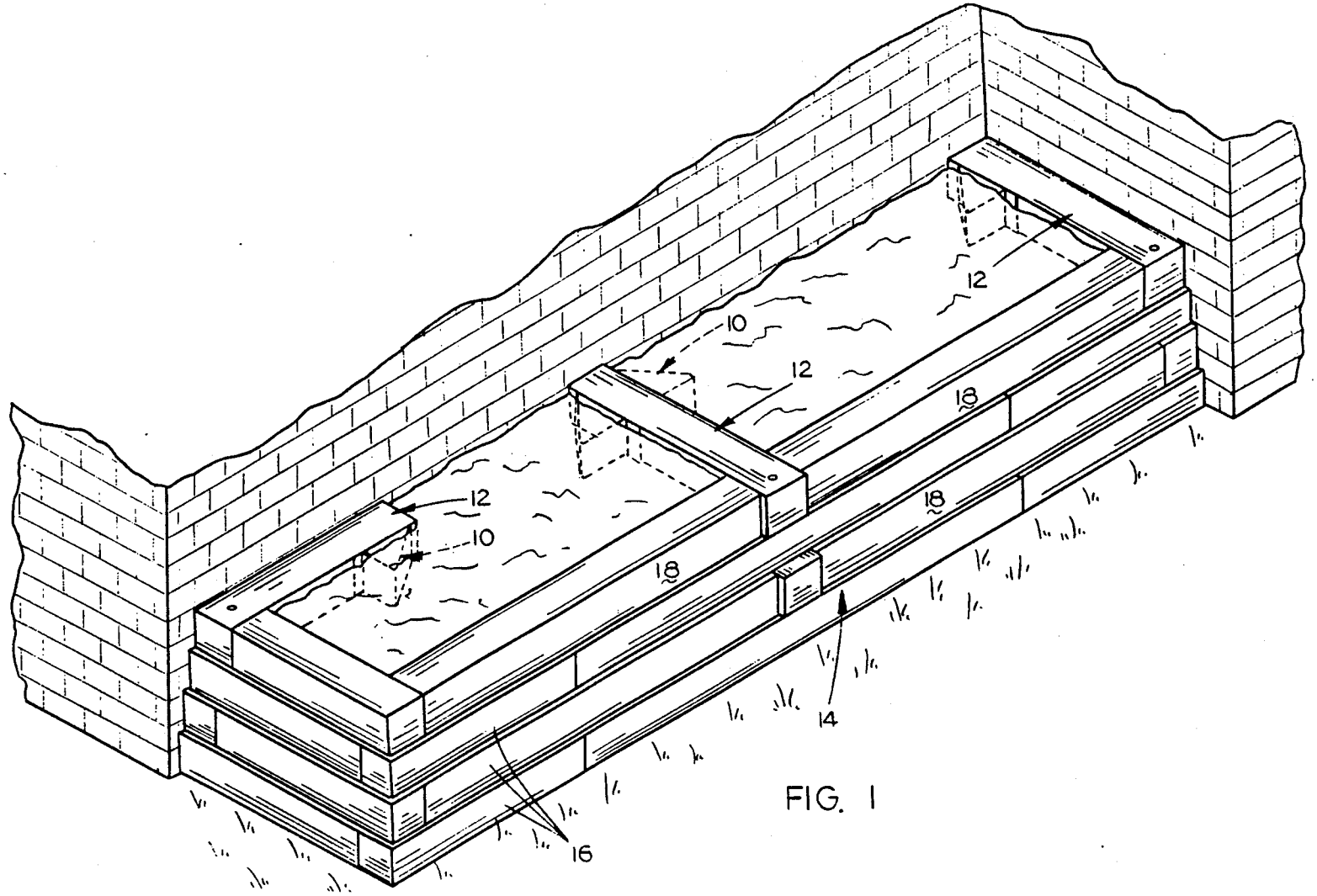
FIG. 1 is a perspective view illustrating a portion of a typical retaining wall wherein the anchor of this invention is employed on the dead man ties.
Figure 2:
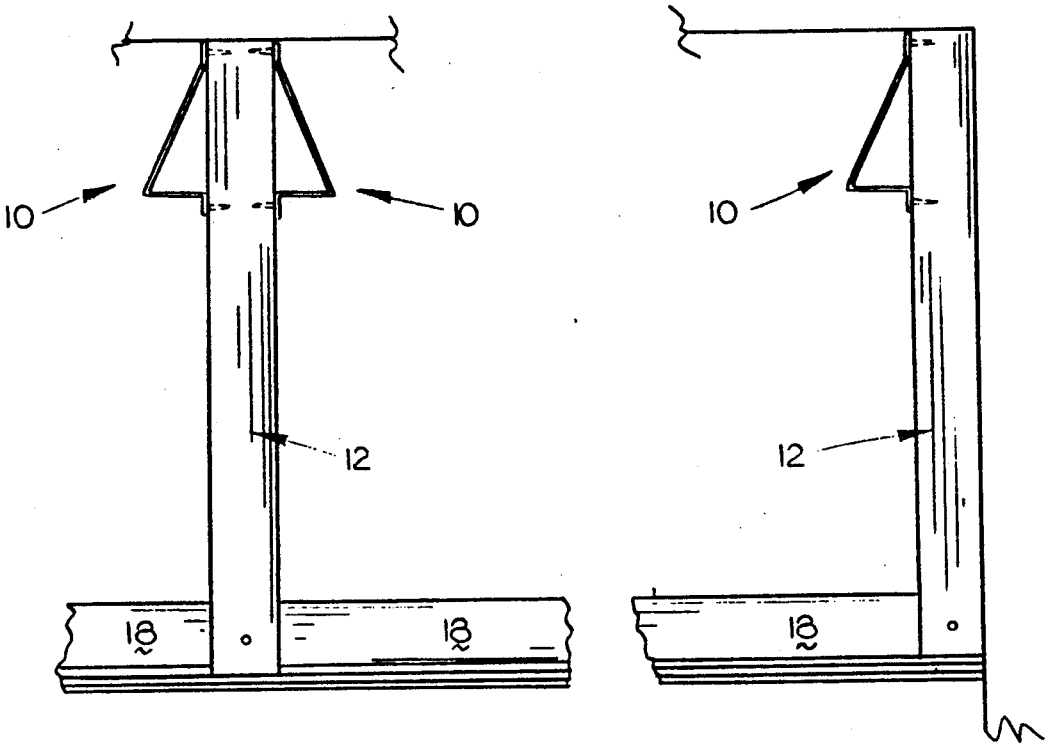
FIG. 2 is a top view illustrating the anchor of this invention being secured to opposite sides of one of the dead man ties and secured to one side of one of the dead man ties.
Figure 3:
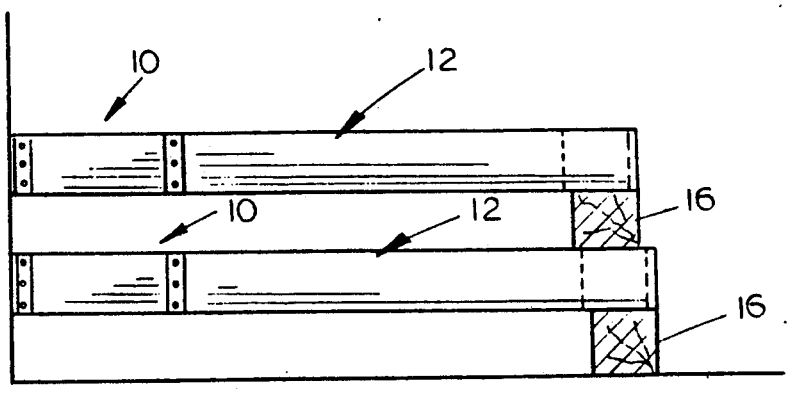
FIG. 3 is a sectional view seen through the retaining wall construction of FIG. 1.
Figure 4:
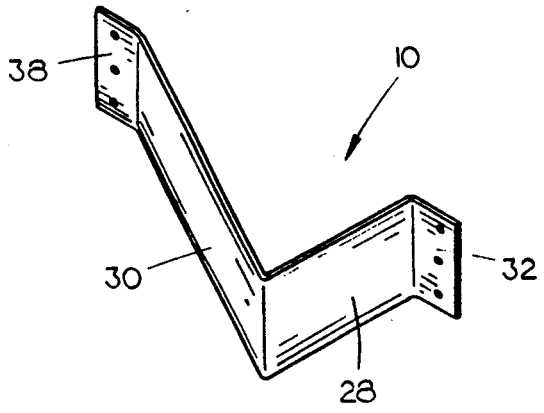
FIG. 4 is a perspective view of the anchor of this invention.
Figure 5:
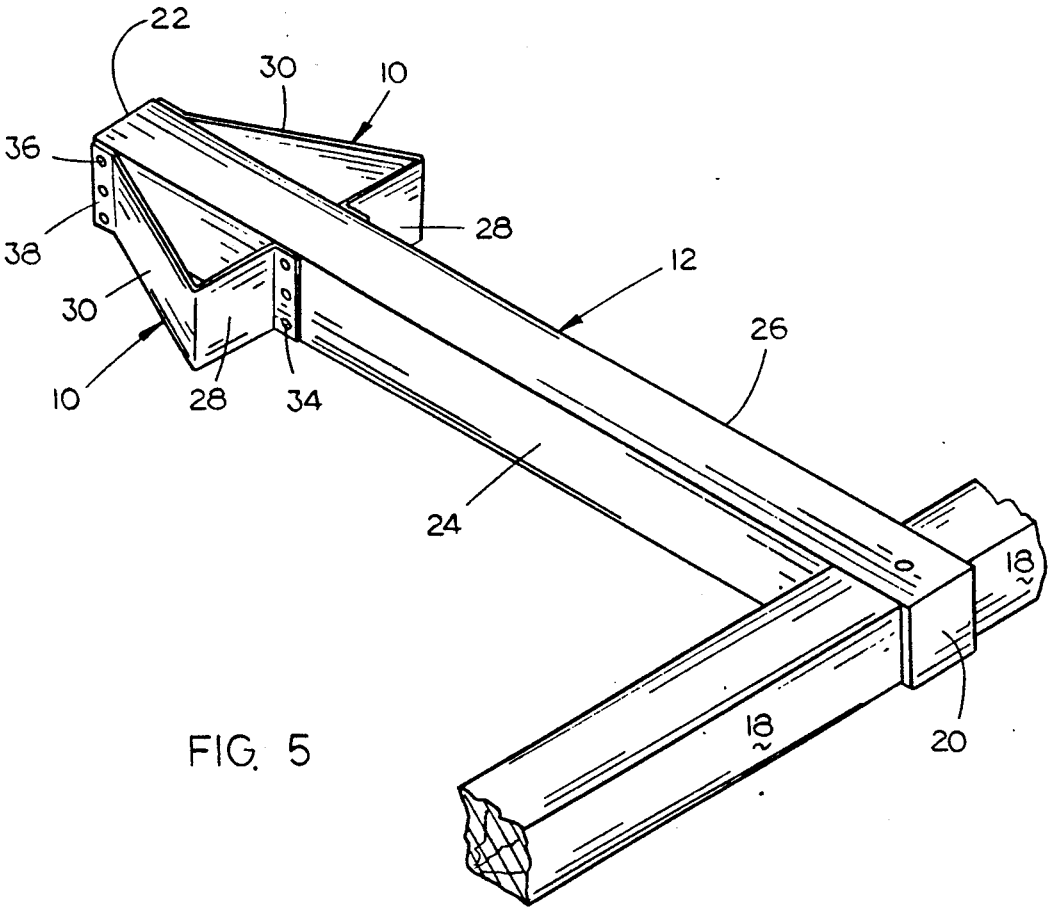
FIG. 5 is a perspective view illustrating a pair of the anchors secured to the rearward or inner end of a dead man tie.

The anchor of this invention is referred to generally by the reference numeral 10 and is designed to be secured to at least one side of a dead man tie referred to generally by the reference numeral 12. The numeral 14 refers to a retaining wall construction comprised of a plurality of rows 16 of ties arranged in an end-to-end relationship. A plurality of the dead man ties 12 are normally positioned in every other row of ties and extend transversely from the ties 18 into the soil being retained by the retaining wall construction 14. Normally, a dead man tie will be employed between the ends of adjacent ties 18 in every other row 16. FIG. 1 illustrates four of the rows 16 but it should be understood that the dead man ties 12 are normally not utilized in the uppermost row of retaining wall ties. It is preferred that the dead man ties 12 normally be covered with at least six inches of earth. It is to the conventional dead man ties that the anchor of this invention is ideally suited whether it be used on one side of the tie as illustrated in FIG. 1 or on both sides of the tie as illustrated in FIG. 1.

Although the drawings illustrate that the ties 18 have a square cross-section, the anchors may be employed with those retaining wall members which have arcuate sides and which are commonly called landscape timbers.

For purposes of description, tie 12 will be described as having a forward end 20 which is positioned between adjacent ends of ties 18 and a rear end 22 which is embedded within the soil being retained. Tie 18 also includes opposite sides 24 and 26. If the dead man tie 12 is positioned adjacent a foundation wall or the like, such as illustrated in FIG. 1, only a single anchor 10 will be employed. However, it is preferred that a pair of anchors 10 be secured to the tie 12 when the tie 12 is sufficiently spaced from foundation wall as also illustrated in FIG. 1.

Anchor 10 includes a first anchor portion 28 which extends transversely outwardly from the side of the tie 12. A second anchor portion 30 extends rearwardly and inwardly from the outer end of anchor portion 28 as seen in the drawings. Anchor 10 is provided with a third anchor portion 32 which extends forwardly from the inner end of anchor portion 28 and which is secured to tie 12 by one or more nails 34 extending therethrough into the tie 12 Anchor portion 36 extends rearwardly from the rearward end of anchor portion 30 and is secured to tie 12 by means of one or more nails 38 extending therethrough into the tie 12.

If the ties 12 are four feet long, as is the usual case, it is recommended that the length of anchor portion 28 be approximately nine inches and that the length of anchor portion 30 be approximately 16 inches. It is also preferred that the length of anchor portions 32 and 36 be approximately two and one-half inches. If the tie 12 has a thickness of six inches, as is the usual case, it is recommended that the height of anchor portions 32, 28 and 30 and 36 be six inches. It is also recommended that the anchor 10 be constructed of 16 gauge galvanized steel.

When the anchors 10 are secured to the tie 12 and the tie 12 is embedded in the soil, anchor portions 28 resist the pulling of the tie 12 from the soil being retained by the retaining wall construction. The anchors 10 also aid in preventing the tie 12 from being pulled from the soil due to the fact that soil is contained within the areas defined between the panel portions 28 and 30.

The anchors are quickly and easily secured to the ties 12 and serve to prevent the ties from being pulled from the soil. Thus, it can be seen that the invention accomplishes at least all of its stated objections.

I claim:

1. A retaining wall construction comprising:

a plurality of rows of wood ties positioned one upon the other, each of said rows comprising a plurality of wood ties arranged in an end-to-end relationship, at least some of said rows of wood ties having at least one elongated dead man tie which extend transversely therefrom into the soil being retained by the retaining wall construction, each of said dead man ties having rearward and forward ends and opposite sides, at least some of said dead man ties having at least a first anchor means extending laterally therefrom which is embedded in the soil being retained by the retaining wall construction, each of said first anchor means comprising a first vertically disposed flat anchor portion extending substantially transversely outwardly from one side of said dead man tie and a second vertically disposed flat anchor portion extending rearwardly and inwardly from the outer end of said first front anchor portion, and means for securing the inner end of said first anchor portion to said dead man tie and for securing the rearward end of said second anchor portion to said dead man tie, said first and second anchor portions defining a generally V-shaped earth receiving area therebetween.

2. The retaining wall of claim 1 wherein said first anchor means is secured to said dead man tie adjacent the rearward end thereof.

3. The retaining wall of claim 1 wherein a second anchor means is secured to the other side of said dead man tie.

4. The retaining wall of claim 1 wherein said first anchor portion comprises a vertically disposed flat plate member.

5. The retaining wall of claim 4 wherein said second anchor portion comprises a vertically disposed flat plate member.

6. A retaining wall construction comprising: a plurality of rows of wood ties positioned one upon the other, each of said rows comprising a plurality of wood ties arranged in an end-to-end relationship, at least some of said rows of wood ties having at least one elongated dead man tie which extend transversely therefrom into the soil being retained by the retaining wall construction, each of said dead man ties having rearward and forward ends and opposite sides, at least some of said dead man ties having at least a first anchor means extending laterally therefrom which is embedded in the soil being retained by the retaining wall construction, each of said first anchor means comprising a first anchor portion extending substantially transversely outwardly from one side of said dead man tie and a second anchor portion extending rearwardly and inwardly from the outer end of said first front anchor portion, and means for securing the inner end of said first anchor portion to said dead man tie and for securing the rearward end of said second anchor portion to said dead man tie, said anchor means including a third anchor portion which extends forwardly from the inner end of said first anchor portion wherein said means for securing said inner end of said first anchor portion to said dead man tie comprises a nail means extending through said third anchor portion into said dead man tie.

7. The retaining wall of claim 6 wherein a fourth anchor portion extends rearwardly from the rearward end of said second anchor portion and wherein said means for securing the rearward end of said second anchor portion to said dead man tie comprises a nail means extending through said fourth anchor portion into said dead man tie.

8. A retaining wall construction comprising:

a plurality of rows of wood ties positioned one upon the other, each of said rows comprising a plurality of wood ties arranged in an end-to-end relationship, at least some of said rows of wood ties having at least one elongated dead man tie which extend transversely therefrom into the soil being retained by the retaining wall construction, each of said dead man ties having rearward and forward ends and opposite sides, at least some of said dead man ties having at least a first anchor means extending laterally therefrom which is embedded in the soil being retained by the retaining wall construction, each of said first anchor means comprising a first anchor portion extending substantially transversely outwardly from one side of said dead man tie and a second anchor portion extending rearwardly and inwardly from the outer end of said first front anchor portion, and means for securing the inner end of said first anchor portion to said dead man tie and for securing the rearward end of said second anchor portion to said dead man tie, said first anchor portion comprising a vertically disposed flat plate member, said second anchor portion comprising a vertically disposed flat plate member, said first and second anchor portions defining a generally V-shaped soil receiving area therebetween.

9. An anchor for attachment to one side of a dead man tie having rearward and forward ends, comprising, a first vertically disposed flat anchor portion having inner and out ends, a second vertically anchor portion extending inwardly at an angle from the outer end of said first anchor portion, and means on the inner ends of said first and second flat anchor portion for attachment ton one side of the tie, said first and second flat anchor portions defining a generally V-shaped soil receiving area therebetween.

10. The anchor of claim 9 wherein said third anchor portion extends forwardly from the inner end of said first anchor portion for positioning adjacent one side of the tie and wherein a fourth anchor portion extends rearwardly from the inner end of said second anchor portion for positioning adjacent the said one side of the tie.

* * * * *